US006241572B1

(12) United States Patent
Braginsky

(10) Patent No.: US 6,241,572 B1
(45) Date of Patent: Jun. 5, 2001

(54) MANIPULABLE BEADED STRING

(76) Inventor: Leonid Braginsky, 107 Hagen Rd., Newton Center, MA (US) 02159

( * ) Notice: Subject to any disclaimer, the term of this patent is extended or adjusted under 35 U.S.C. 154(b) by 0 days.

(21) Appl. No.: 09/048,951

(22) Filed: Mar. 26, 1998

(51) Int. Cl.[7] ..... A63H 33/04; G09B 23/00; B21L 11/12

(52) U.S. Cl. ..... 446/85; 446/119; 446/490; 446/107; 434/211; 434/278; 59/2; 59/92; 63/38

(58) Field of Search ..... 446/85, 102, 107, 446/119, 490; 434/211, 216, 278, 279; 59/2, 79.2, 79.1, 79.3, 80, 92; 63/5.1, 5.2, 11, 38; 132/275

(56) References Cited

U.S. PATENT DOCUMENTS

| | | | | |
|---|---|---|---|---|
| Re. 29,574 | * | 3/1978 | Pethick et al. | 446/490 |
| 1,771,278 | * | 7/1930 | Weiner | 63/38 |
| 3,190,086 | * | 6/1965 | Klein | 59/2 |
| 3,222,072 | * | 12/1965 | Dreyer | 446/119 |
| 3,577,673 | * | 5/1971 | Monestier | 446/490 |
| 3,597,872 | | 8/1971 | Vennola | 46/1 R |
| 3,751,769 | * | 8/1973 | Reiner . | |
| 4,778,184 | * | 10/1988 | Fleischer | 446/490 |
| 4,997,375 | * | 3/1991 | Heinz | 446/119 |
| 5,110,297 | * | 5/1992 | Teague | 434/278 |
| 5,302,148 | | 4/1994 | Heinz | 446/119 |
| 5,386,710 | * | 2/1995 | Moore | 63/2 |
| 5,525,089 | * | 6/1996 | Heinz | 446/119 |
| 5,836,802 | * | 11/1998 | Harnett | 446/367 |
| 5,890,497 | * | 4/1999 | Tsai | 132/273 |

* cited by examiner

*Primary Examiner*—Robert A. Hafer
*Assistant Examiner*—Laura Fossum
(74) *Attorney, Agent, or Firm*—Wolf, Greenfield & Sacks, P.C.

(57) ABSTRACT

A manipulatable beaded string toy device comprising of a plurality of interconnectable elements, each element including a number of beads disposed on a cord. When the plurality of interconnectable elements are interconnected, a junction formed comprises at least four beads, two from each cord, each of the at least four beads is in contact with at least three other beads of the junction.

32 Claims, 16 Drawing Sheets

MANIPULABLE BEADED STRING

FIELD OF THE INVENTION

This invention relates to configurable elements, and more particularly to beaded string elements which may be configured into a number of different geometric, three-dimensional forms.

BACKGROUND OF THE INVENTION

Beaded string construction devices are known in the art. For example, U.S. Pat. No. 3,577,673 to Monestier, discloses a dismemberable toy having solid blocks on an elastic cord. The block faces have slots that intersect to create a passageway for the cord. The assembly may be manipulated by moving the cord into the slotted faces of each block, to cause sections of the toy to bend at 90° angles relative to previous sections. However, since the toy is held in place by the flat sides of the blocks, non-cubic shapes having curved coincidental sides would not be able to be held in place relative to each other. Also, although Monestier discloses that more than one assembly may be interconnected, only two such assemblies may be used to form a single junction.

U.S. Pat. No. 5,302,148 to Heinz discloses an educational toy which allows the user to assemble building blocks along a flexible cord to form various shapes. This toy relies on the flat sides of the building blocks to hold the building blocks in place, and Heinz does not teach connecting more than one toy together.

U.S. Pat. No. 4,997,375 to Heinz discloses a toy having a number of blocks interconnected by an elastic cord which passes through the center of the blocks. Again, the toy relies on the flat sides of the building blocks and the elastic force between blocks to hold the building blocks in place, and Heinz does not teach connecting more than one toy together.

U.S. Pat. No. 3,222,072 to Dryer discloses a block puzzle in which a number of cubes are interconnected by an elastic cord. The user must manipulate the puzzle in order to form different shapes. Dryer does not teach connecting more than one puzzle together.

U.S. Pat. No. 3,597,872 to Vennola discloses a toy having a number of mutually connected bodies arranged in a row along an elastic cord. Each body is shaped such that turning the body allows the user to form a nonlinear shapes by turning the bodies relative to one another. Vennola also does not teach connecting more than one cord together.

SUMMARY OF THE INVENTION

According to one aspect of the present invention, a construction device includes a first pair of beads and a second pair of beads. Each of the first and second pairs of beads is disposed a cord. When the first and second pairs of beads are interconnected, a junction is formed including four beads, with each of the four beads being in contact with three other beads.

According to another aspect, the first pair of beads and the second pair of beads may be disposed together on a single cord to form an element According to yet another aspect, the first pair of beads may be disposed on the first cord to form a first element and the second pair of beads may be disposed on the second cord to form a second element.

According to another aspect of the invention, a method for manipulating a beaded string element including at least first and second pairs of beads disposed on a cord includes the steps of: placing a first portion of the cord between the first pair of beads transverse to a second portion of the cord between the second pair of beads; stretching at least one of the first portion and the second portion of the cord to open at least one gap between at least one of the first pair of beads and the second pair of beads; partially wrapping the first portion of the cord around the second portion of the cord; and closing the at least one gap between the at least one of the first pair of beads and the second pair of beads while the first portion of the cord is partially wrapped around the second portion of the cord.

According to yet another aspect of the invention, a method for manipulating first and second beaded string elements includes the steps of: placing a first cord on which a first pair of beads is disposed transverse to a second cord on which a second pair of beads is disposed; stretching the first cord and/or the second cord to open at least one gap between the first pair of beads and/or the second pair of beads; partially wrapping the first cord around the second cord; and closing the at least one gap between the first pair of beads and/or the second pair of beads while the first cord is partially wrapped around the second cord.

DETAILED DESCRIPTION

Figure 1A:
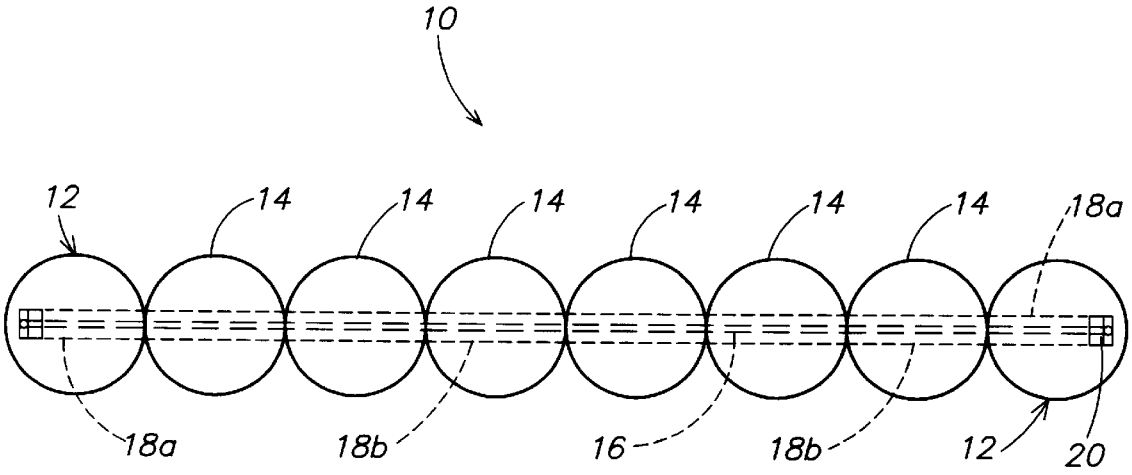
FIG. 1A is a diagram showing a beaded sting element according to one embodiment of the present invention.

FIG. 1A is a diagram showing a beaded string element 10 according to one embodiment of the present invention. Beaded string element 10 includes two end beads 12, a number of intermediate beads 14 and an elastic cord 16, shown in phantom in FIG. 1A. Although the beads are illustrated as being spherical in shape, non-spherical beads alternatively may be used. For example, oblong beads or multi-faceted beads may be used. In the embodiment shown in FIG. 1A, end beads 12 are formed such that a hole 18*a* passes partially through a center of the bead, and intermediate beads 14 are formed such that a hole 18*b* passes completely through the center of the bead.

Beaded string element 10 may be formed by permanently attaching one end bead 12 to the end of elastic cord 16, threading a number of intermediate beads 14 along the length of the elastic cord 16 and permanently attaching a second end bead 12 to the other end of the elastic cord 16. The length of cord 16 is such that, when end beads 12 and the desired number (which may be zero) of intermediate beads 14 are disposed on cord 16, cord 16 is slightly stretched beyond its relaxed state, thereby retaining beads 12 and 14 (or beads 12 and 12 if no intermediate beads 14 are used) together with slight force. This configuration allows beaded string element 10 to be stretched in order to form gaps between each adjacent pair of beads. This stretching property enables one or more beaded string elements to be manipulated and/or interconnected to form a number of different geometric, three-dimensional shapes, as described in further detail below.

Figure 1B:
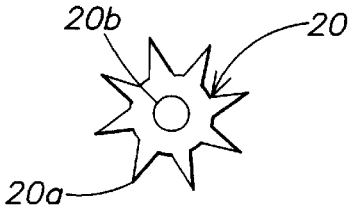
FIG. 1B is a diagram showing an anchor that may be used in the beaded string element shown in FIG. 1A.

FIG. 1B shows an anchor 20 (also shown in FIG. 1A) that may be used to secure elastic cord 16 within one of end beads 12. As shown, anchor 20 may be a bendable disk having outward-pointing barbs 20*a*. Anchor 20 also includes a hole 20*b* through which elastic cord 16 may be threaded. Hole 20*b* may be of a size smaller than the diameter of a elastic cord 16 to allow anchor 20 to frictionally hold elastic cord 16 in place after it has been threaded through hole 20*b*. Alternatively, a knot may be tied in elastic cord 16 after it has been thread through hold 20*b* to prevent anchor 20 from slipping off of elastic cord 16. The diameter of anchor 20 is slightly larger than the diameter of hole 18*a* of end bead 12. Thus, when anchor 20 is pressed into hole 18*a*, it bends, allowing it to be pressed into the smaller diameter holder 18*a*. The barbs 20*a* of anchor 20 seat themselves into end bead 12, thereby preventing anchor 20 from being pulled out of hole 18*a*.

The ends of elastic cord 16 may alternatively be glued inside the holes 18*a* of end beads 12, or may otherwise frictionally fit inside the holes 18*a* of end beads 12. For example, elastic cord 16 may be attached to a cylindrical bead having a diameter slightly larger than the diameter of hole 18*a*. The cylindrical bead may be forced into hole 18*a* to effect a tight friction fit, thereby retaining elastic cord 16 inside end bead 12.

Figure 1C:
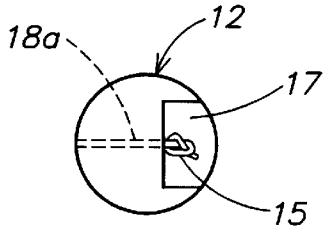
FIG. 1C is a diagram showing an alternative embodiment of one of the end beads shown in FIG. 1A.

FIG. 1C shows one embodiment of an end bead 12 in which hole 18*a* passes completely through the bead. In this embodiment, an end of cord 16 may be threaded through hole 18*a* of end bead 12 and a knot 15 may be tied in cord 16 to hold end bead 12 in place. In the embodiment shown, bore 17, which has a diameter that is slightly larger than that of hole 18*a*, is formed concentrically with hole 18*a* on one side of end bead 12. Knot 15 may thereby be maintained within the confines of bore 17, rather than projecting beyond the surface of end bead 12. Bore 17 may optionally be covered or filled with a sealant to improve the appearance and functionality of the beaded string element.

Figure 2A:
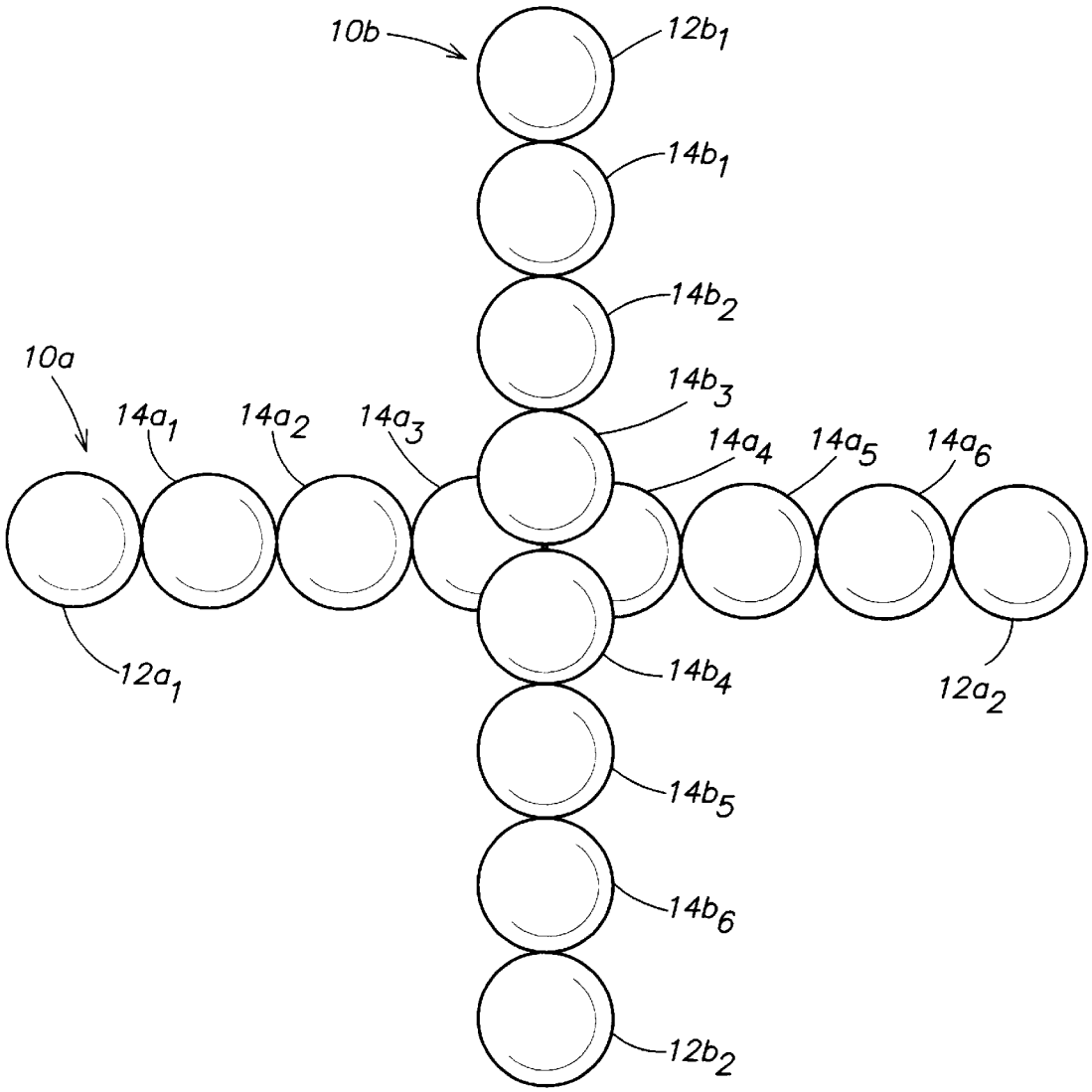
FIGS. 2A–2C are diagrams showing the steps involved in connecting together two beaded string elements.

A method of interconnecting multiple beaded string elements will now be discussed with reference to FIGS. 2A–2C. First, as shown in FIG. 2A, a beaded string element 10*b*, including end beads $\mathbf{12}b_1$, $\mathbf{12}b_2$ and intermediate beads $\mathbf{14}b_1$–$\mathbf{14}b_6$ is placed adjacent beaded string element 10*a*, which includes end beads $\mathbf{12}a_1$, and $\mathbf{12}a_2$ and intermediate beads $\mathbf{14}a_1$–$\mathbf{14}a_6$. Specifically, intermediate beads $\mathbf{14}b_3$ and $\mathbf{14}b_4$ are placed adjacent and between intermediate beads $\mathbf{14}a_3$ and $\mathbf{14}a_4$.

Figure 2B:
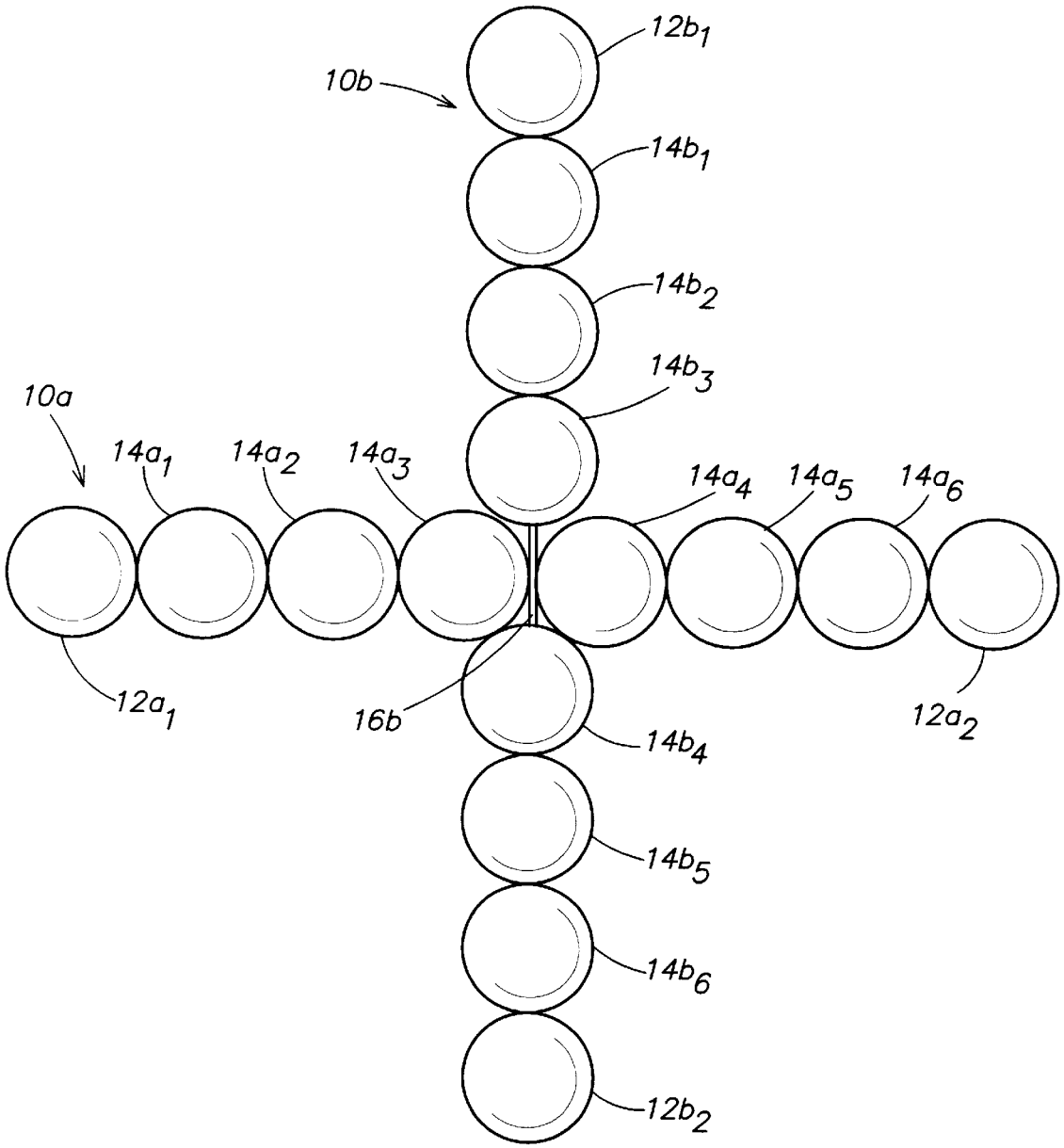

Next, as illustrated in FIG. 2B, when beaded string element 10*b* is pushed toward beaded string element 10*a*, intermediate beads $\mathbf{14}a_3$ and $\mathbf{14}a_4$ push intermediate beads $\mathbf{14}b_3$ and $\mathbf{14}b_4$ apart causing beaded string element 10*b* to stretch such that a gap is formed between intermediate beads $\mathbf{14}b_3$ and $\mathbf{14}b_4$. Elastic cord 16*b* is exposed, allowing intermediate beads $\mathbf{14}b_3$ and $\mathbf{14}b_4$ to pass from one side of intermediate beads $\mathbf{14}a_3$ and $\mathbf{14}a_4$, around to the other side of intermediate beads $\mathbf{14}a_3$ and $\mathbf{14}a_4$, where intermediate beads $\mathbf{14}b_3$ and $\mathbf{14}b_4$ snap back together due to the force of elastic cord 16*b*. This connection results in elastic cord 16*b* being partially wrapped around elastic cord 16*a* (not shown). It should be appreciated that pushing string element 10*b* toward string element 10*a* may also cause intermediate beads $\mathbf{14}a_3$ and $\mathbf{14}a_4$ to be pushed apart to expose cord 16*a*, thereby also forming a gap between beads $\mathbf{14}a_3$ and $\mathbf{14}a_4$ when making the connection.

Figure 2C:
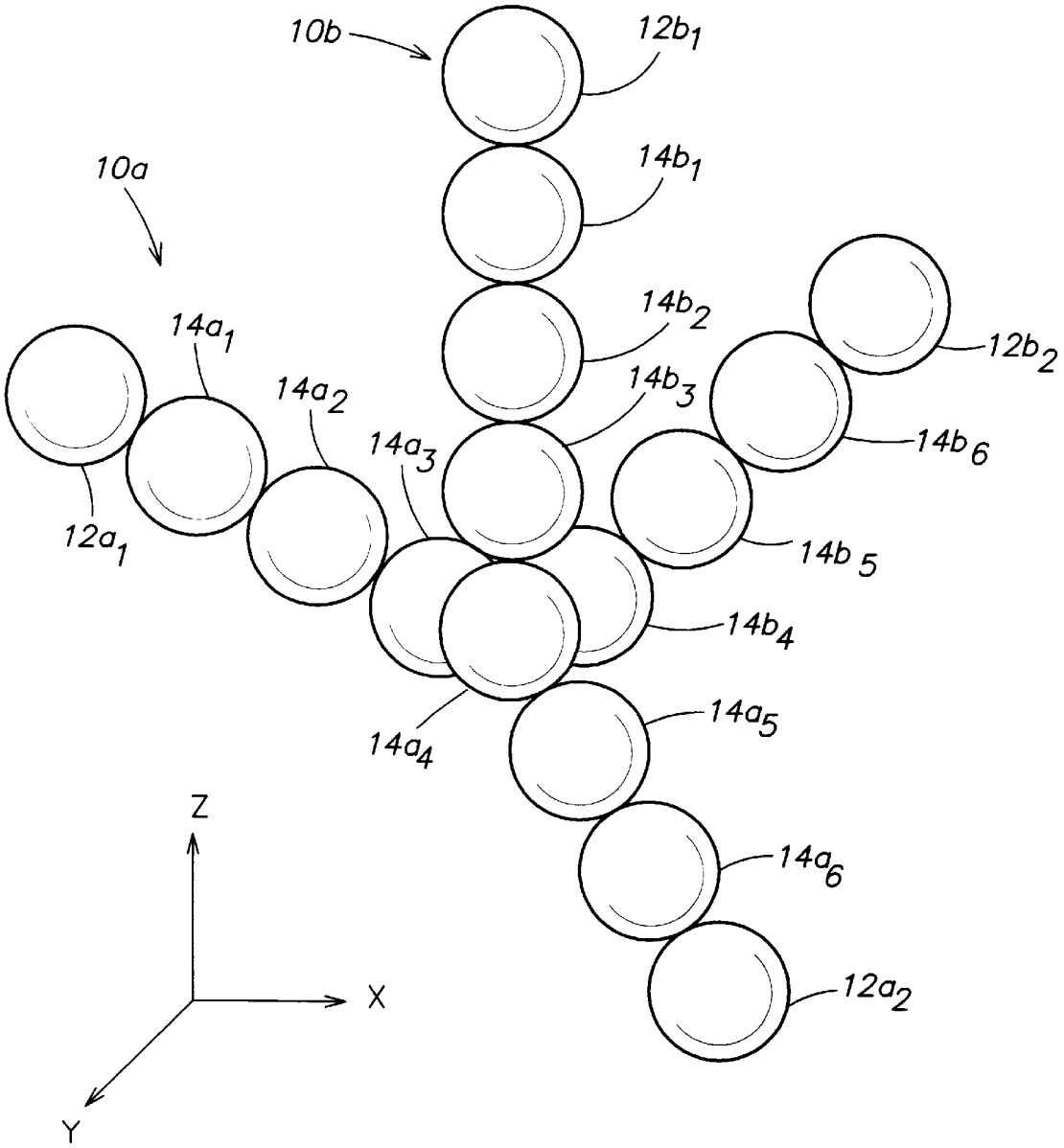

FIG. 2C shows how the beaded string elements may appear after performing the method illustrated in FIGS. 2A and 2B. As shown, the junction between string elements 10*a* and 10*b* includes four beads, i.e., beads $\mathbf{14}a_3$, $\mathbf{14}a_4$, $\mathbf{14}b_3$, and $\mathbf{14}b_4$, with each of these four beads being in contact with the three other beads included in the junction.

Figure 3:
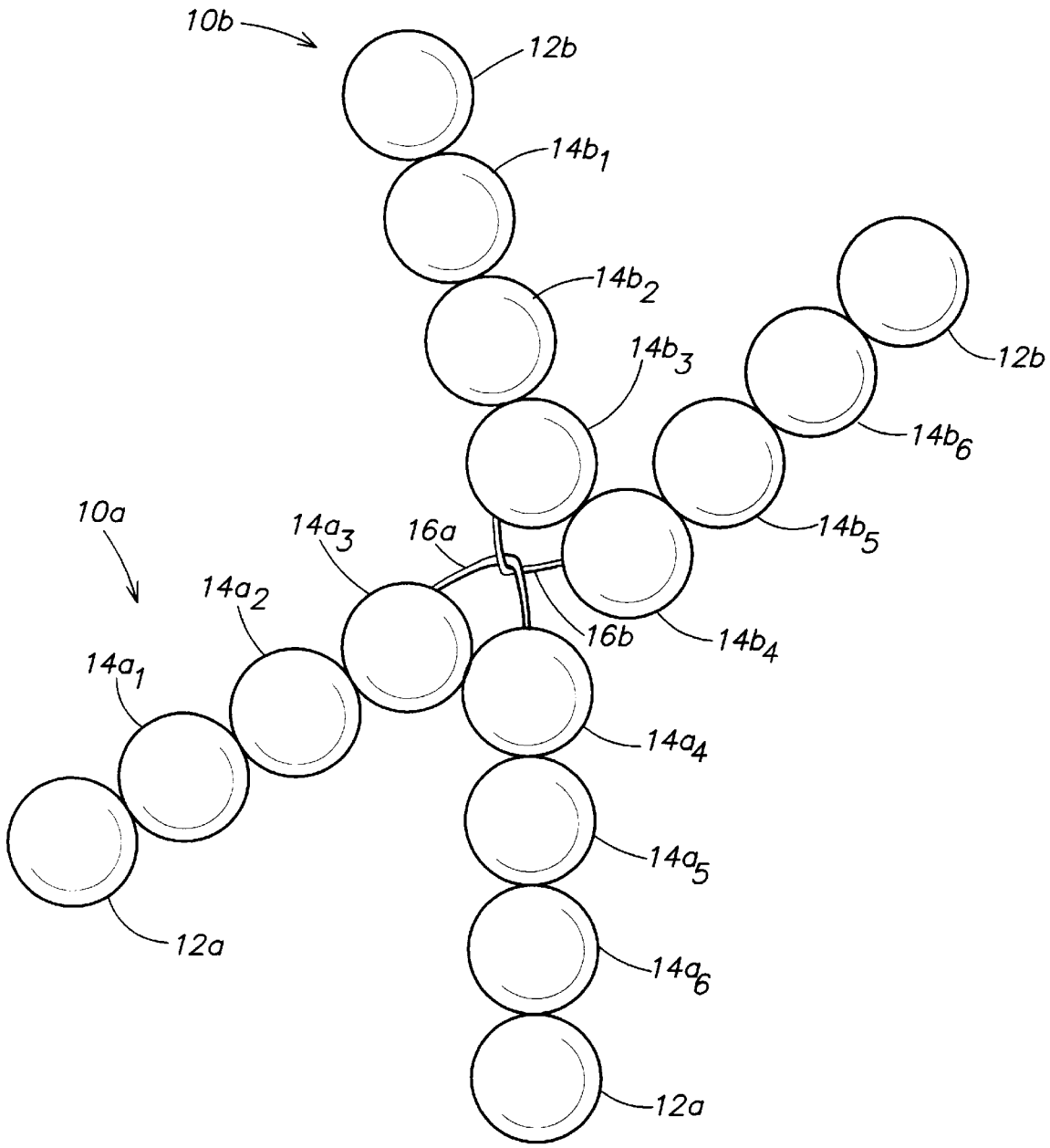
FIG. 3 is a diagram showing the connection of two beaded string elements.

FIG. 3 shows an exploded view of the junction of beaded string elements 10*a* and 10*b* shown in FIG. 2C and illustrates the relationship between the elastic cords 16*a* and 16*b* of string elements 10*a* and 10*b*. As shown, when beaded string element 10*a* is connected to beaded string element 10*b* as described above, elastic cord 16*a* is partially wrapped around elastic cord 16*b*. Due to the wrapping of the elastic cords around one another, the spherical beads are held in place and do not require interfacing flat surfaces to hold the beads in place. The junction(s) that may be formed by the elements enables many different, aesthetically pleasing geometrical shapes to be formed.

While in the example above beaded string elements 10*a* and 10*b* are shown as intersecting one another at a mid-point of each element, the beaded string elements may be connected at any point between two beads along either element. Additionally, while the example above illustrates how two beaded string elements may be connected together, it should be appreciated that similar connections may be made between any two pairs of adjacent beads on the same string element. For example, a junction may be formed that includes beads $\mathbf{12}a_1$, $\mathbf{14}a_1$, $\mathbf{14}a_6$ and $\mathbf{12}a_2$ of beaded string element 10*a*, with each of these beads contacting the other beads in the junction and with string 16*a* being partially wrapped around itself.

Figure 4A:
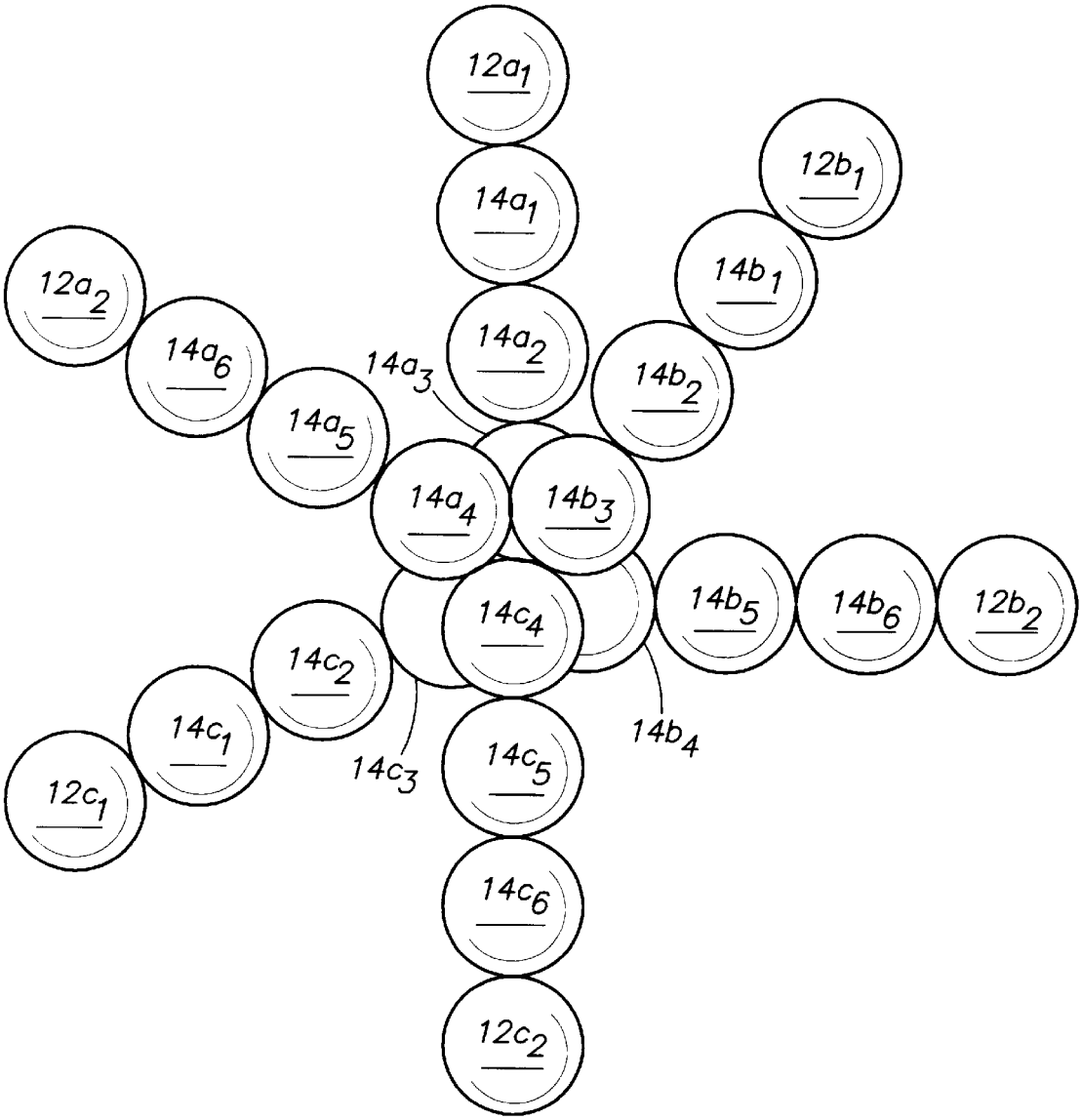
FIGS. 4A and 4B are diagrams showing the connection of three beaded string elements.

FIG. 4A shows an example of how three or more beaded string elements may be interconnected to form a more complex shape. In the example shown, three beaded string elements 10*a*, 10*b*, and 10*c* are connected such that a single junction is formed by all three elements. In the case of three beaded string elements being connected to form a single junction, six beads form the junction, with each bead being in contact with four other beads of the junction. In the example shown, beads $\mathbf{14}a_3$ and $\mathbf{14}a_4$ of string element 10*a*, beads $\mathbf{14}b_3$ and $\mathbf{14}b_4$ of string element 10*b*, and beads $\mathbf{14}c_3$ and $\mathbf{14}c_4$ of string element 10*c* form a junction, with each of beads $\mathbf{14}a_3$, $\mathbf{14}a_4$, $\mathbf{14}b_3$, $\mathbf{14}b_4$, $\mathbf{14}c_3$ and $\mathbf{14}c_4$ being in contact with four other beads in the junction.

Figure 4B:
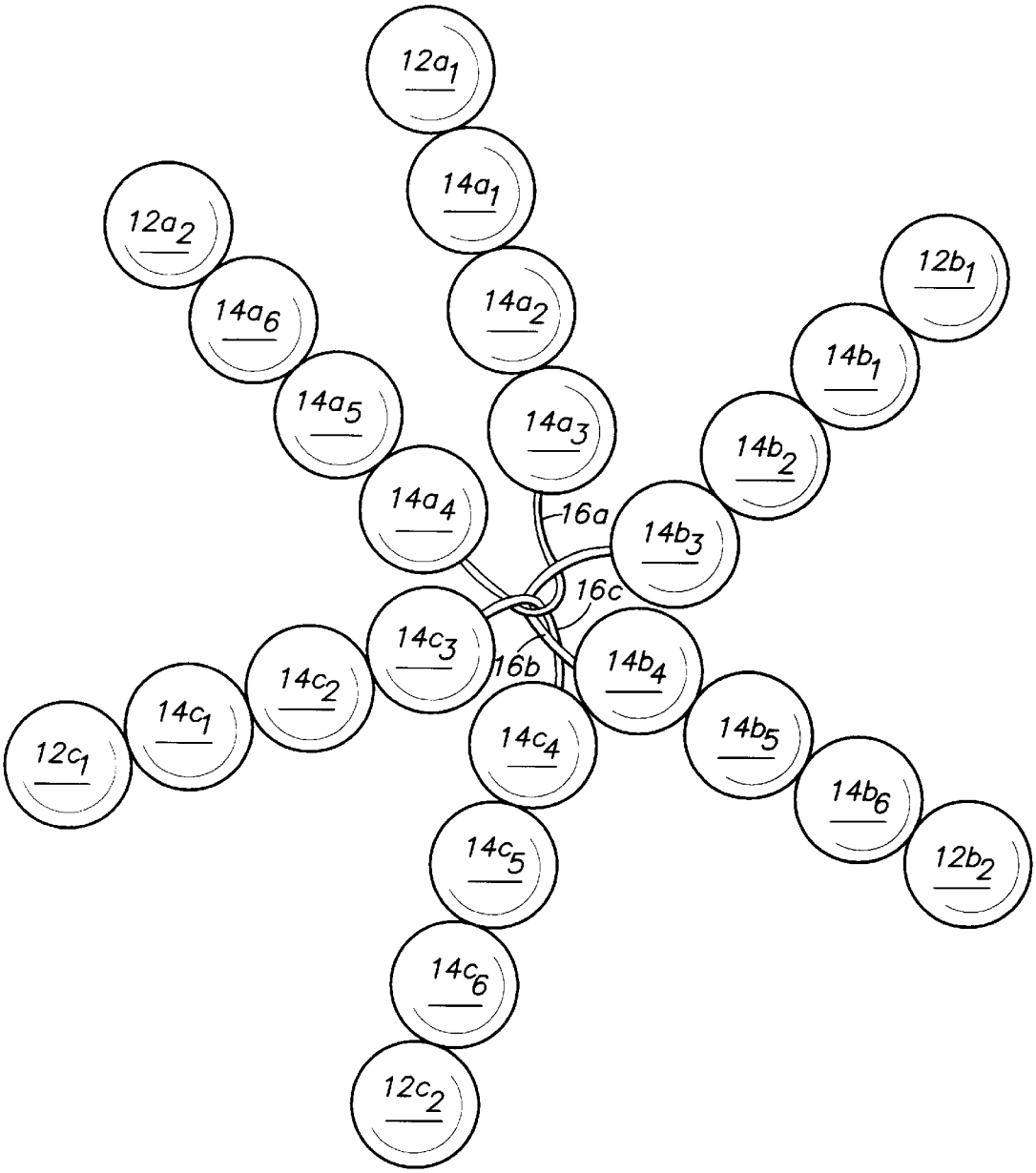

FIG. 4B shows an exploded view of the junction of beaded string elements 10*a*, 10*b* and 10*c* shown in FIG. 4A and illustrates one possible relationship between the elastic cords 16*a*, 16*b* and 16*c*. As shown, when beaded string element 10*a*, 10*b* and 10*c* are connected together, each of elastic cords 16*a*, 16*b* and 16*c* is partially wrapped around at least one of the other cords. Due to the wrapping of the elastic cords around one another, the beads are held in place.

Figure 5A:
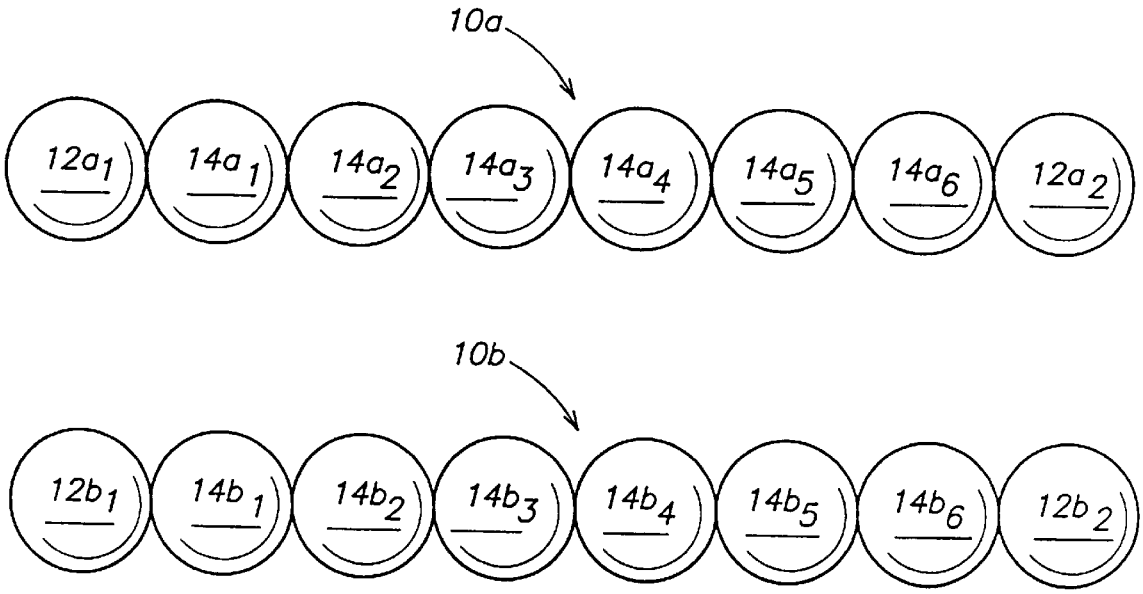
FIG. 5A is a diagram showing two, eight-bead string elements that are separate from one another.
Figure 5B:
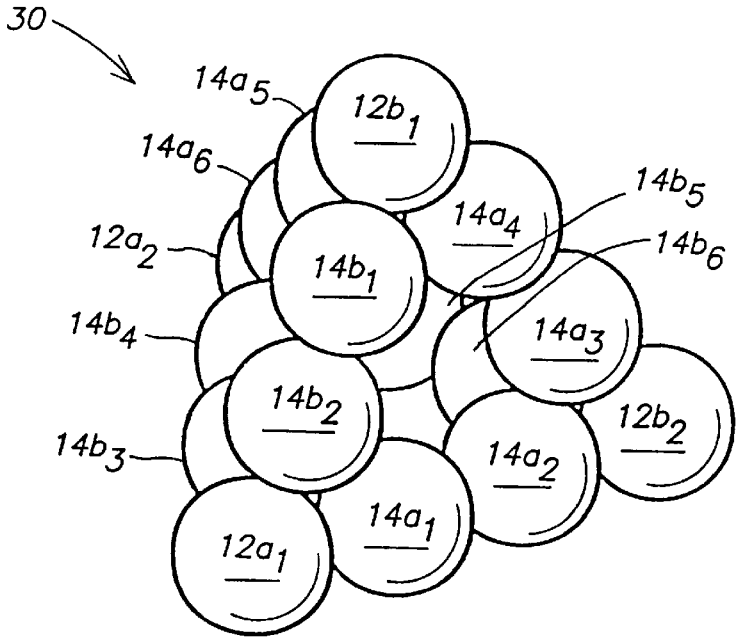
FIG. 5B is a diagram showing a tetrahedron that may be formed using the two eight-bead string elements shown in FIG. 5A.

In addition to the connections shown in the examples above, many different geometrical, three-dimensional shapes may be formed using an embodiment of the beaded string elements described above. For example, two eight-beaded stringed elements may be used to form a tetrahedron. A description of a method for forming the tetrahedron 30 shown in FIG. 5B using the two beaded string elements 10*a* and 10*b* shown in FIG. 5A will now be discussed with reference to FIGS. 6A–9B.

Figure 6A:
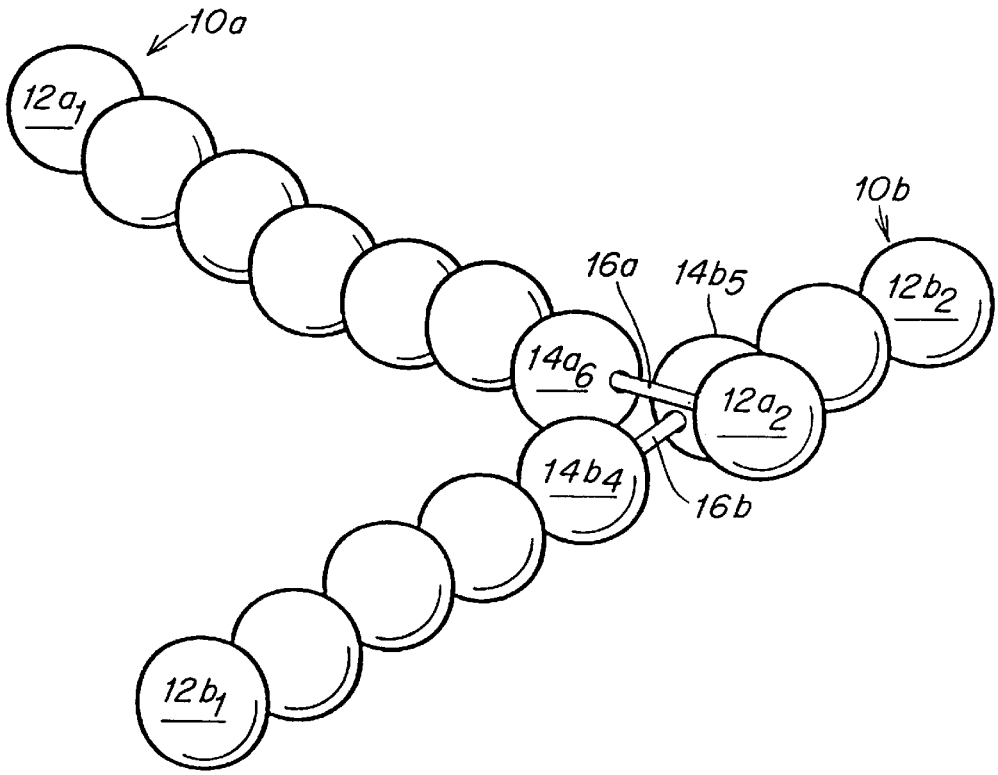
FIGS. 6A, 7A, 8A and 9A are diagrams showing the steps involved in forming the tetrahedron shown in FIG. 5B.
Figure 6B:
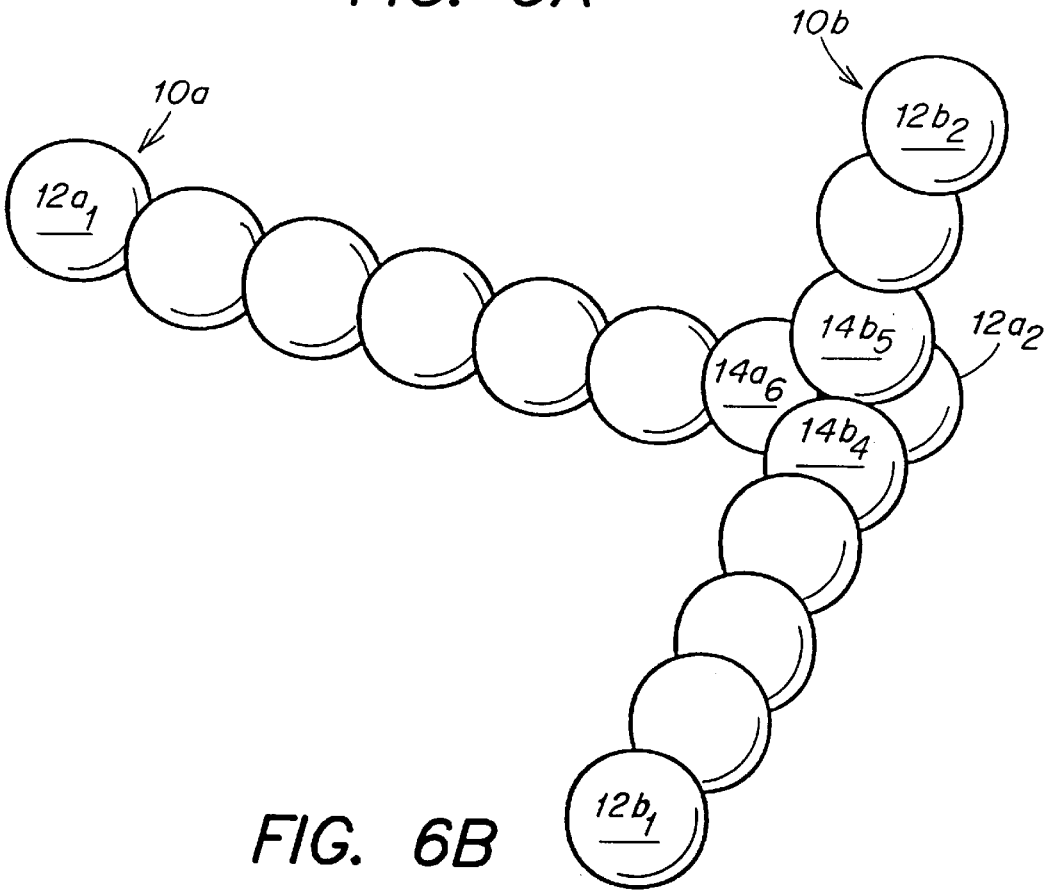
FIGS. 6B, 7B, 8B and 9B are diagrams showing the structure that results following the completion of the steps shown in FIGS. 6A, 7A, 8A and 9A, respectively.

As shown in FIG. 6A, element 10*a* first is placed adjacent element 10*b* such that intermediate beads $\mathbf{14}b_4$ and $\mathbf{14}b_5$ are adjacent and between intermediate bead $\mathbf{14}a_6$ and end bead $\mathbf{12}a_2$. Element 10*a* is pushed toward element 10*b* in order to stretch elastic cord 16*a* and/or elastic cord 16*b,* thereby forming a gap between intermediate beads $\mathbf{14}b_4$ and $\mathbf{14}b_5$ and/or between intermediate bead $\mathbf{14}a_6$ and end bead $\mathbf{12}a_2$, respectively. As element 10*a* is pushed toward element 10*b,* intermediate beads $\mathbf{14}b_4$ and $\mathbf{14}b_5$ are forced around intermediate bead $\mathbf{14}a_6$ and end bead $\mathbf{12}a_2$ such that elastic cord 16*a* partially wraps around elastic cord 16*b.* The beads then snap back together to form a junction such as that shown in FIG. 2C. FIG. 6B shows how the beaded strings 10*a* and 10*b* may appear after the step illustrated in FIG. 6A has been performed.

Figure 7A:
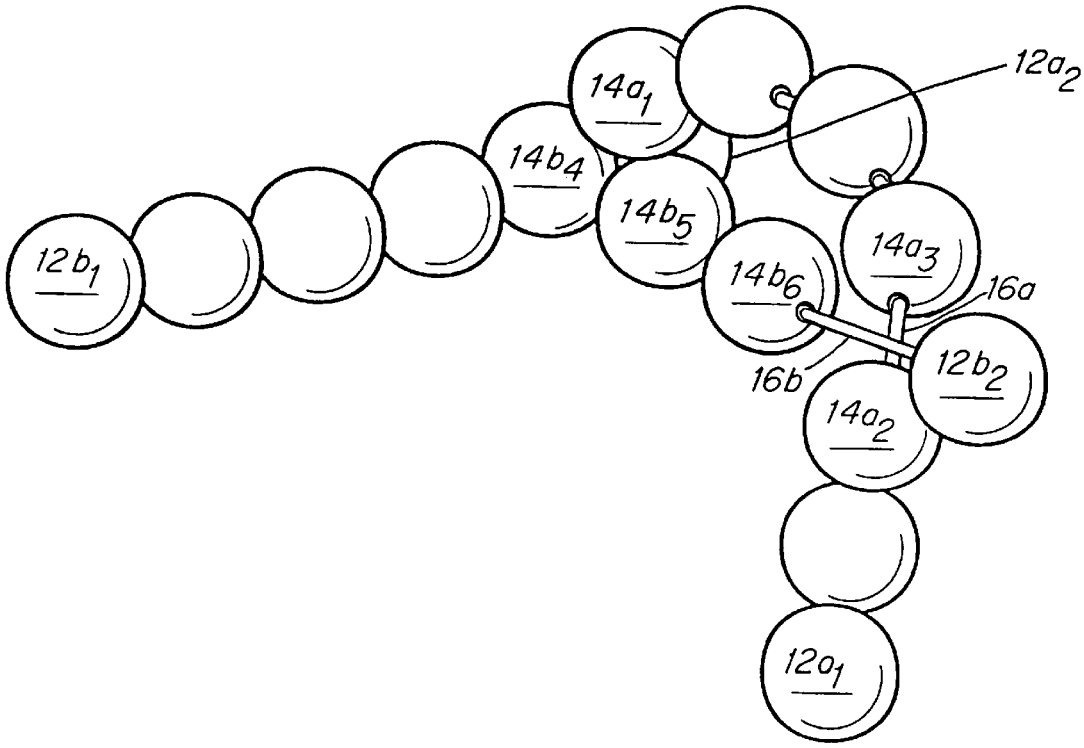
Figure 7B:
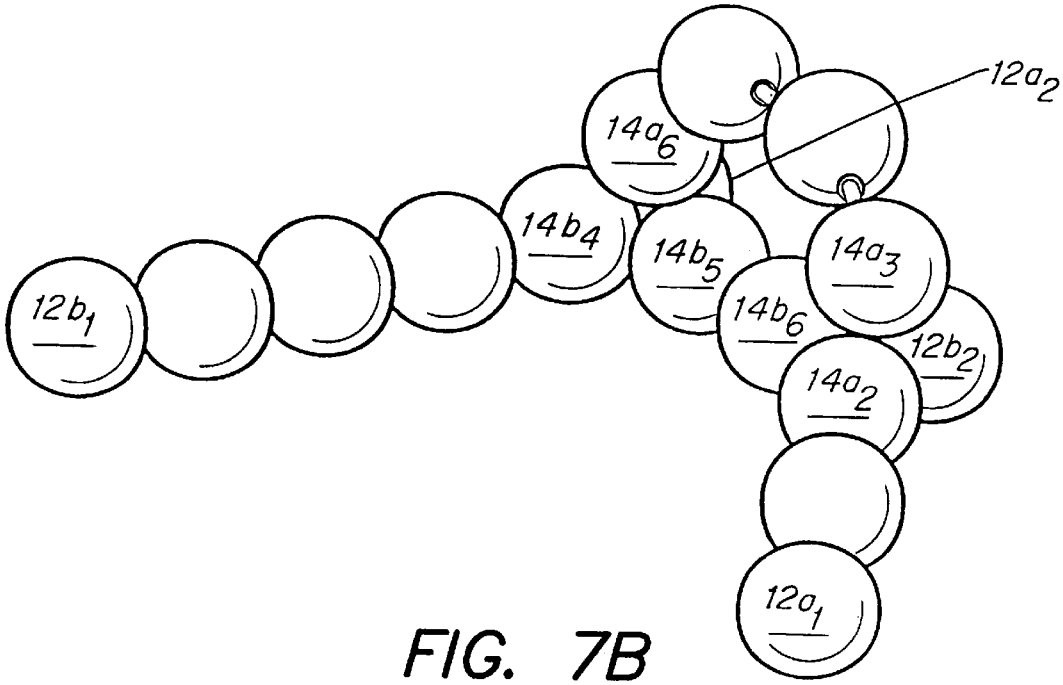

As shown in step 7A, intermediate bead $\mathbf{14}b_6$ and end bead $\mathbf{12}b_2$ of beaded string 10*b* next are placed adjacent and between intermediate beads $\mathbf{14}a_2$ and $\mathbf{14}a_3$ of beaded string 10*a* and are forced around intermediate beads $\mathbf{14}a_2$ and $\mathbf{14}a_3$ such that elastic cord 16*b* wraps around elastic cord 16*a* to form a second junction. FIG. 7B shows how the beaded strings 10*a* and 10*b* may appear after the step illustrated in FIG. 7A has been performed.

Figure 8A:
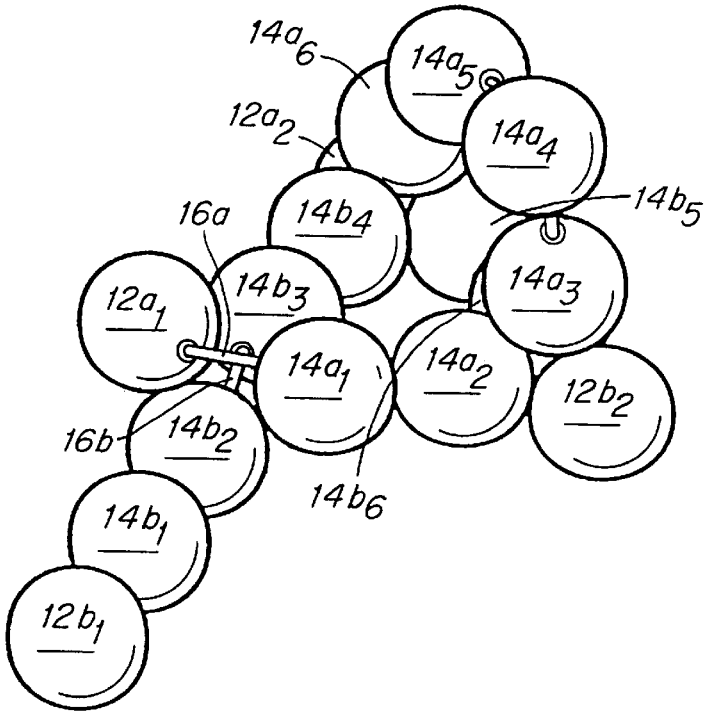
Figure 8B:
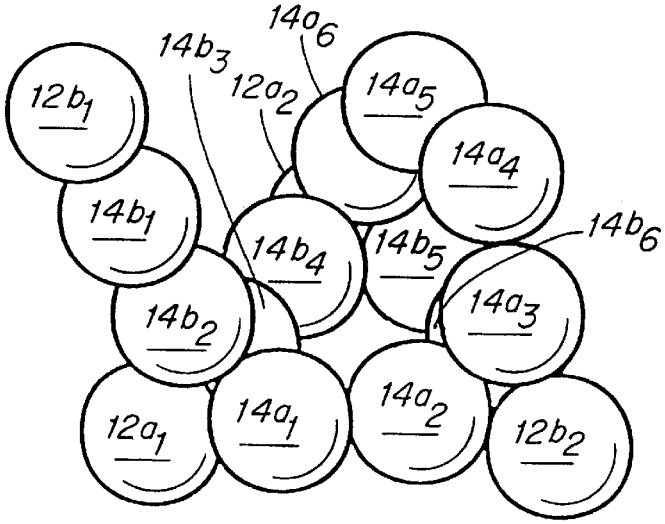

As shown in FIG. 8A, intermediate bead 14*a,* and end bead $\mathbf{12}a_1$ of beaded string 10*a* next are placed adjacent and between intermediate beads $\mathbf{14}b_2$ and $\mathbf{14}b_3$ of beaded string 10*b* and are forced around intermediate beads $\mathbf{14}b_2$ and $\mathbf{14}b_3$ to form a third junction. FIG. 8B shows how the beaded strings 10*a* and 10*b* may appear after the step shown in FIG. 8A has been performed.

Figure 9A:
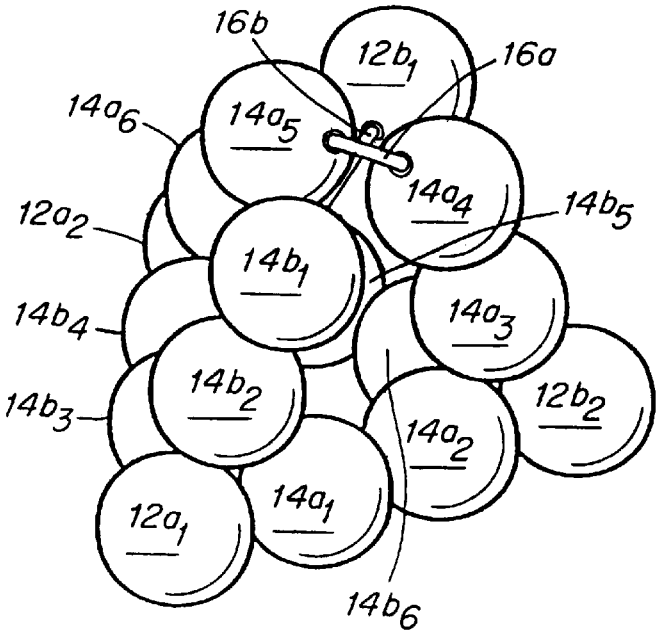
Figure 9B:
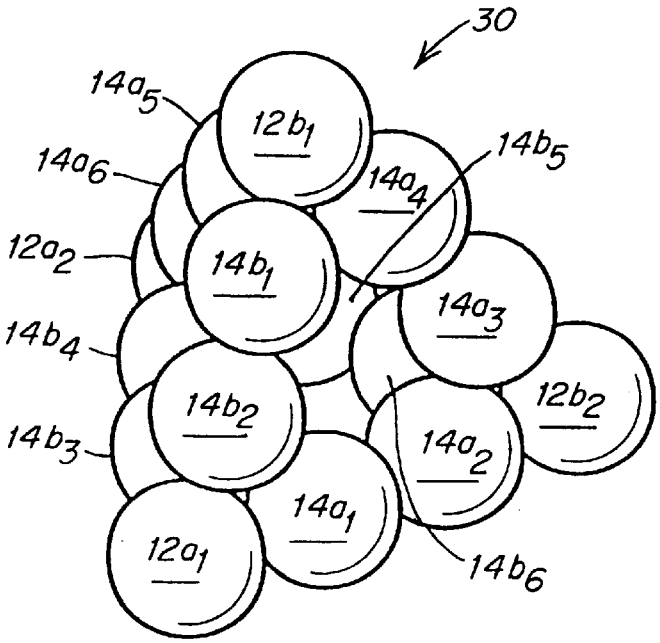
Figure 10:
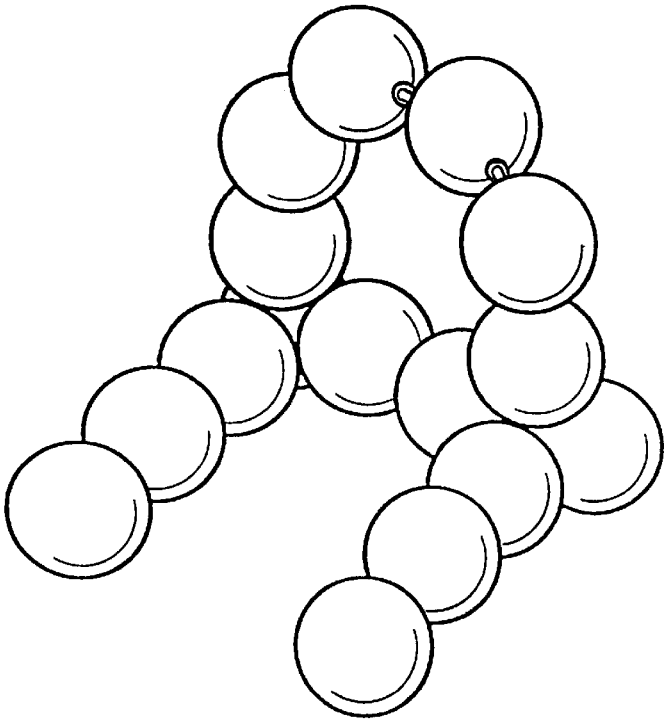
FIGS. 10–17 are diagrams showing examples of different shapes that may be formed by beaded string elements configured according to one embodiment of the invention.
Figure 11:
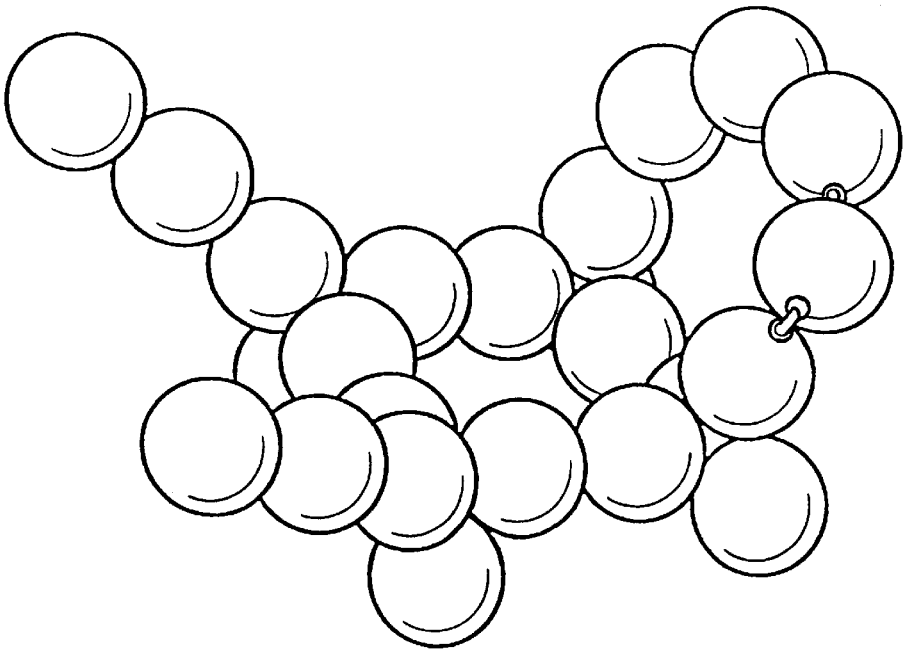
Figure 12:
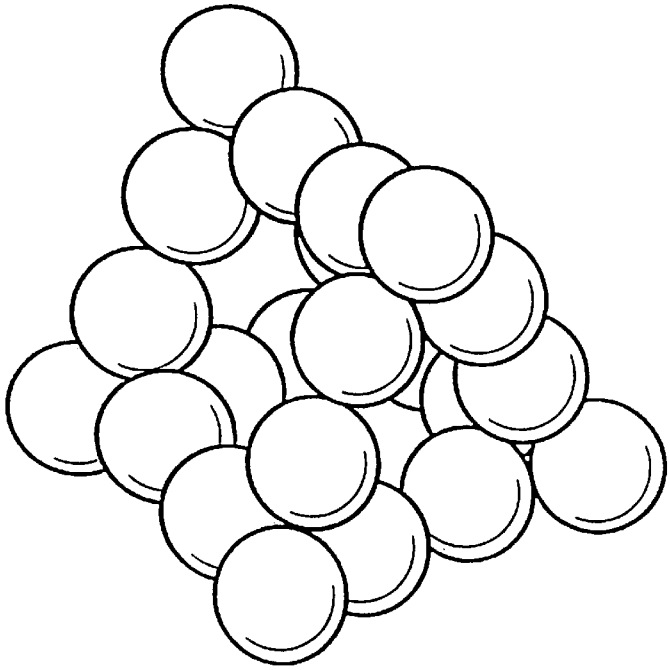
Figure 13:
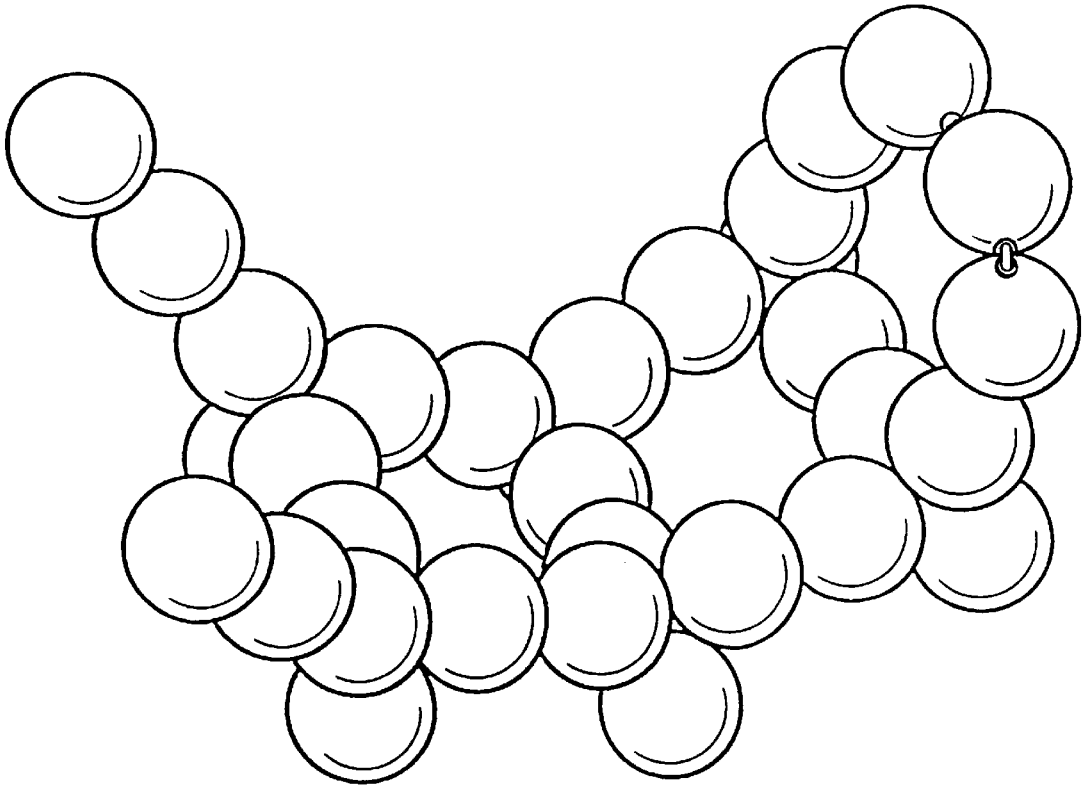
Figure 14:
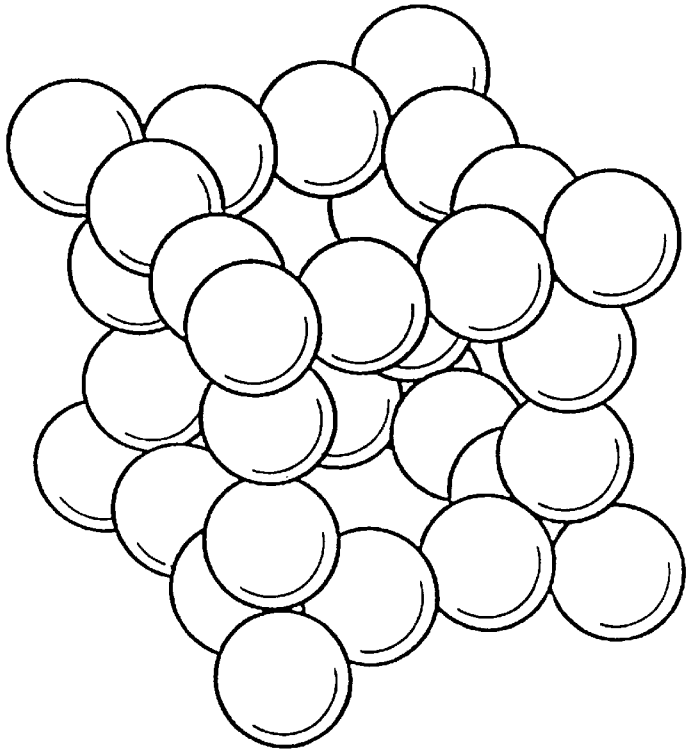
Figure 15:
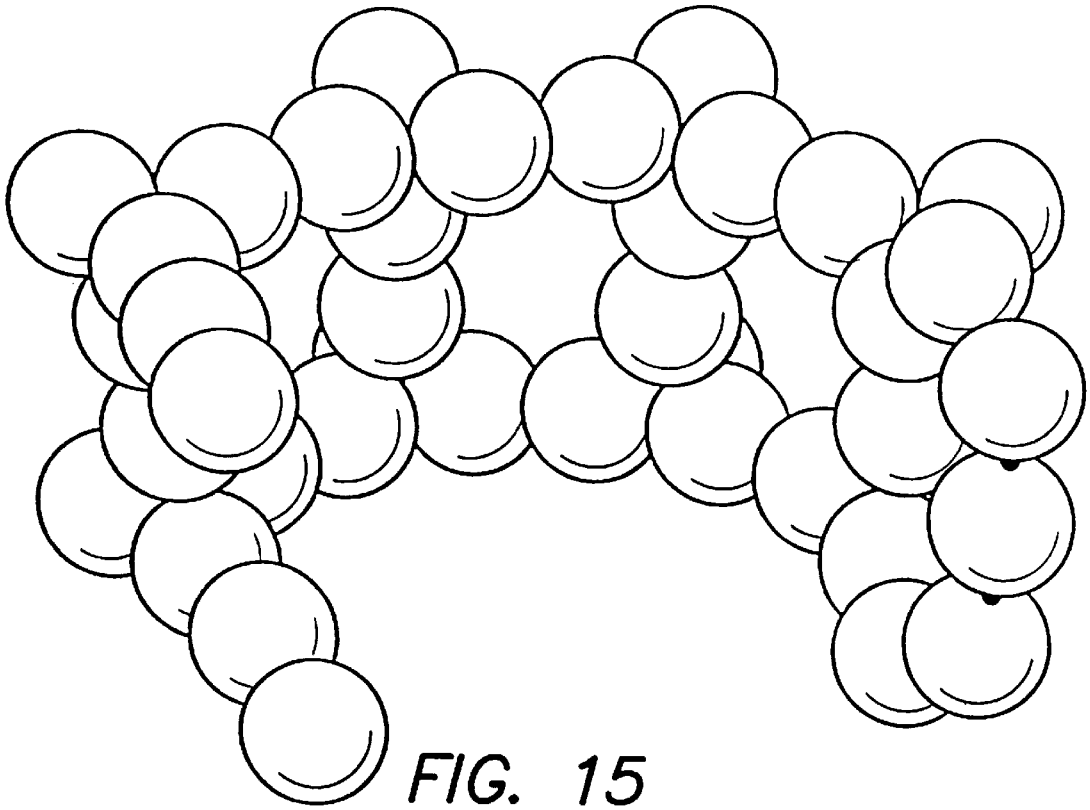
Figure 16:
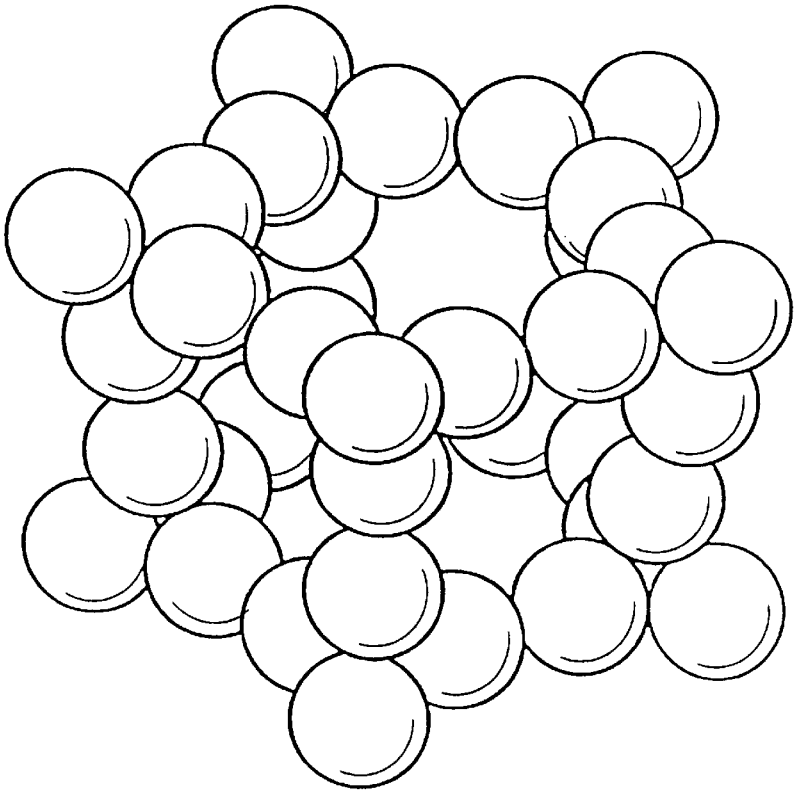
Figure 17:
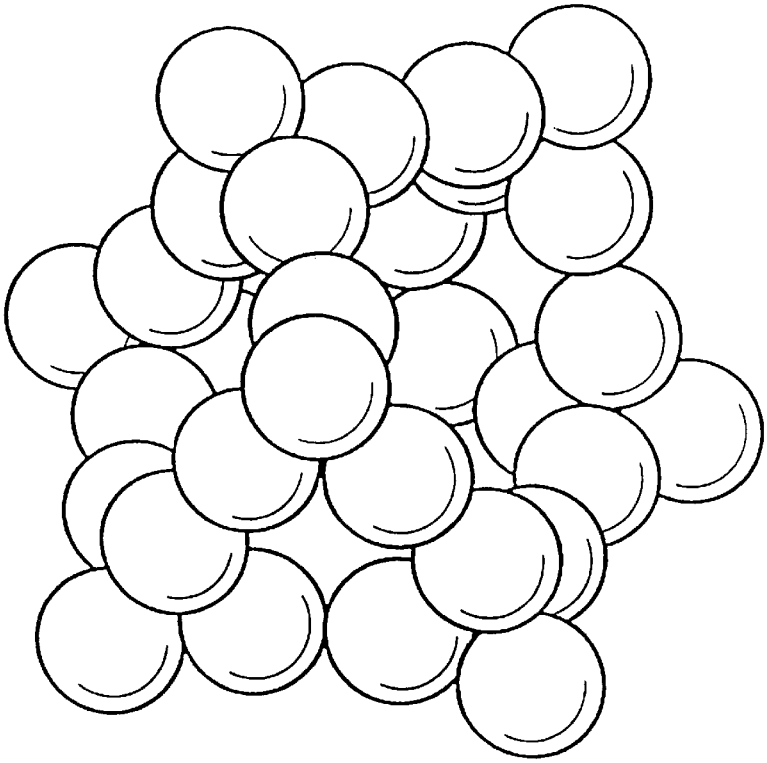

As shown in FIG. 9A, end bead 12*b,* and intermediate bead 14*b,* of beaded string 10*b* next are passed through a gap formed between intermediate beads $\mathbf{14}b_1$, $\mathbf{14}b_6$ and $\mathbf{14}a_3$–$\mathbf{14}a_6$ and are placed adjacent and between intermediate beads $\mathbf{14}a_4$ and $\mathbf{14}a_5$. End bead $\mathbf{12}b_1$ and intermediate bead 14*b,* then are forced around intermediate beads $\mathbf{14}a_4$ and 14*a* to form a fourth junction of the tetrahedron 30. FIG. 9*b* shows how the beaded strings 10*a* and 10*b* form tetrahedron 30 after the step illustrated in FIG. 9A has been performed.

In forming each of the junctions of tetrahedron 30, when a pair of beads and the associated elastic cord is stretched over and between a second pair of beads to form a four-bead junction as described above, each of the four beads in the junction contacts the other three beads in the junction and the elastic cord associated with the first pair of beads partially wraps around the elastic cord associated with the second pair of beads.

Many other geometric shapes may be formed from the beaded string elements described above. Examples of such shapes are shown in FIGS. 10–17. Each of these shapes may be formed by employing the method illustrated in FIGS. 2A–C several times to interconnect two or more beaded string elements as shown.

Beads 12 and 14 may be formed from wood or any suitable other material, such as plastic or metal. Elastic cord 16 may be made from a wound elastic cord or any other resilient, stretchable material, such as rubber or plastic. Any number of beads may be used to make up a beaded string element, and beaded elements of different lengths and number of beads may be used together to form various shapes. In addition to linear string elements, circular beaded string elements or beaded string elements of other shapes may be formed and used to construct different shapes.

Having thus described an embodiment of the invention, various alterations, modifications and improvements will readily occur to those skilled in the art. Such alterations, modifications and improvements are intended to be within the spirit and scope of the invention. Accordingly, the foregoing description is by way of example only and is not intended to be limiting.

What is claimed is:

1. A method for manipulating a beaded string element, comprising steps of:

(a) providing the beaded string element including at least first and second pairs of beads disposed on a single cord, each of the first pair of beads being disposed on the single cord adjacent the other of the first pair of beads, and each of the second pair of beads being disposed on the single cord adjacent the other of the second pair of beads, wherein the length of said single cord is less than or equal to the sum of the diameters of all of said beads, such that when said single cord is in a relaxed state, each of said beads is in physical contact with the beads which are adjacent thereto;

(b) placing a first portion of the single cord between the first pair of beads transverse to a second portion of the single cord between the second pair of beads when each of the first pair of beads is in physical contact with the other of the first pair of beads and each of the second pair of beads is in physical contact with the other of the second pair of beads;

(c) stretching at least one of the first portion and the second portion of the single cord to open at least one gap between at least one of the first pair of beads and the second pair of beads;

(d) placing the first portion of the single cord in physical contact with the second portion of the single cord;

(e) wrapping the first portion of the single cord at least partially around the second portion of the single cord;

(f) closing the at least one gap between the at least one of the first pair of beads and the second pair of beads while the first portion of the single cord is in physical contact with and at least partially wrapped around the second portion of the single cord and so that each of the first pair of beads is in physical contact with the other of the first pair of beads and each of the second pair of beads is in physical contact with the other of the second pair of beads: and (g) repeating the steps (a), (b), (c), (d), (e), and (f) at least once using another set-of first and second pairs of beads disposed on the single cord to create at least one geometric figure with the beaded string element.

2. The method of claim 1, wherein the step of providing the beaded string element includes a step of providing the beaded string element such that each of the beads included in the first and second pairs of beads is spherical in shape.

3. The method of claim 1, wherein the such of closing the at least one gap includes a step of closing the at least one gap such that each of the beads included in the first and second pairs of beads contacts the other three beads included in the first and second pairs of beads.

4. The method of claim 1, wherein the step of providing the beaded string element includes a step of providing the beaded string element such that each of the beads included in the first and second pairs of beads is made of a material selected from a group consisting of plastic, metal and wood.

5. The method of claim 1, wherein the step of providing the beaded string element includes a step of providing the beaded string element such that each of the first pair of beads is of a same size and shape as the other of the first pair of beads.

6. The method of claim 1, wherein the step of providing the beaded string element includes a step of providing the beaded string element such that all of the beads included in the first and second pairs of beads are of a same size and shape.

7. The method of claim 2, wherein the step of providing the beaded string element includes a step of providing the beaded string element such that all of the beads included in the first and second pairs of beads are of a same size and shape.

8. The method of claim 1, wherein the step of providing the beaded string element includes a step of providing the beaded string element such that no manipulable objects other than beads are disposed on the single cord.

9. The method of claim 1, wherein the step of providing the beaded string element includes a step of providing the beaded string element such that each end of the single cord is terminated with a respective bead.

10. A method for manipulating a plurality of beaded string elements, comprising steps of:

(a) providing at least first and second separate beaded string elements including respective first and second separate cords having respective first and second pairs of beads disposed thereon such that neither of the first pair of beads is disposed on the second cord and neither of the second pair of beads is disposed on the first cord, each of the first pair of beads being disposed on the first cord adjacent the other of the first pair of beads, and each of the second pair of beads being disposed on the second cord adjacent the other of the second pair of beads wherein the length of said first cord is less than or equal to the sum of the diameters of all of the beads thereon and the length of said second cord is less tan or equal to the sum of the diameters of all of the beads thereon, such that when said first and second cords are in a relaxed state, each of said beads, on their respective cords, is in physical contact with the beads which are adjacent thereto;

(b) placing a portion of the first cord between the first pair of beads transverse to a portion of the second cord between the second pair of beads when each of the first pair of beads is in physical contact with the other of the first pair of beads and each of the second pair of beads is in physical contact with the other of the second pair of beads;

(c) stretching at least one of the first cord and the second cord to open at least one gap between at least one of the first pair of beads and the second pair of beads;

(d) placing the portion of the first cord between the first pair of beads in physical contact with the portion of the second cord between the second pair of beads;

(e) wrapping the portion of the first cord between the first pair of beads at least partially around the portion of the second cord between the second pair of beads; and (f) closing the at least one gap between the at least one of the first pair of beads and the second pair of beads while the portion of the first cord between the first pair of beads is in physical contact with and at least partially wrapped around the portion of the second cord between the second pair of beads and so that each of the first pair of beads is in physical contact with the other of the first pair of beads and each of the second pair of beads is in physical contact with the other of the second pair of beads.

11. The method of claim 10, wherein the step of providing the at least first and second separate beaded string elements includes a step of providing the at least first and second separate beaded string elements such that each of the beads included in the first and second pairs of beads is spherical in shape.

12. The method of claim 11, wherein the step of providing the at least first and second separate beaded string elements includes a step of providing the at least first and second separate beaded string elements such that all of the beads included in the first and second pairs of beads are of a same size and shape.

13. The method of claim 10, wherein the step of closing the at least one gap includes a step of closing the at least one gap such that each of the beads included in the first and second pairs of beads contacts the other three beads included in the first and second pairs of beads.

14. The method of claim 10, wherein the step of providing the at least first and second separate beaded string elements includes a step of providing a third beaded string element including a third pair of beads disposed on a third cord that is separate from each of the first and second separate cords, and wherein the method further includes steps of:

placing a portion of the third cord between the third pair of beads transverse to each of the portion of the first cord between the first pair of beads and the portion of the second cord between the second pair of beads;

stretching at least one of the first, second, and third cords to open at least one gap between at least one of the first, second and third pairs of beads;

placing the portion of the third cord between the third pair of beads in physical contact with each of the portion of the first cord between the first pair of beads and the portion of the second cord between the second pair of beads;

wrapping the portion of the third cord between the third pair of beads at least partially around each of the portion of the first cord between the first pair of beads and the portion of the second cord between the second pair of beads; and closing the at least one gap between the at least one of the first, second, and third pairs of beads while the third portion of the third cord is in physical contact with and at least partially wrapped around each of the portion of the first cord between the first pair of beads and the portion of the second cord between the second pair of beads.

15. The method of claim 14, wherein the step of closing the at least one gap between the at least one of the first, second, and third pairs of beads includes a step of closing the at least one gap between the at least one of the first, second, and third pairs of beads such that each of the beads included in the first, second, and third pairs of beads contacts four other beads included in the first, second, and third pairs of beads.

16. The method of claim 10, wherein the step of providing the at least first and second separate beaded string elements includes a step of providing the at least first and second separate beaded string elements such that each of the beads included in the first and second pairs of beads is made of a material selected from a group consisting of plastic, metal and wood.

17. The method of claim 10, wherein the step of providing the at least first and second separate beaded string elements includes a step of providing the first beaded string element such that each of the first pair of beads is of a same size and shape as the other of the first pair of beads.

18. The method of claim 10, wherein the step of providing the at least first and second separate beaded string elements includes a step of providing the at least first and second separate beaded string elements such that all of the beads included in the first and second pairs of beads are of a same size and shape.

19. The method of claim 10, wherein the step of providing the at least first and second separate beaded string elements includes a step of providing the at least first and second separate beaded string elements such that no manipulable objects other than beads are disposed on either of the first and second separate cords.

20. The method of claim 10, wherein the step of providing the at least first and second separate beaded string elements includes a step of providing the at least first and second separate beaded string elements such that each end of each of the first and second separate cords is terminated with a respective bead.

21. The method of claim 10, further comprising a step of:

(g) repeating the steps (a), (b), (c), (d), (e), and (f) at least once using another set of first and second pairs of beads disposed, respectively, on the first and second separate cords to create at least one geometric figure with the plurality of beaded string elements.

22. A method for manipulating a plurality of beaded string elements, comprising steps of:

(a) providing at least first and second separate beaded string elements including respective first and second separate cords having respective first and second pairs of beads disposed thereon, each end of each of the first and second separate cords being terminated with a respective bead, each of the first pair of beads being disposed on the first cord adjacent the other of the first pair of beads, and each of the second pair of beads being disposed on the second cord adjacent the other of the second pair of beads, wherein the length of said first cord is less than or equal to the sum of the diameters of all of the beads thereon and the length of said second cord is less than or equal to the sum of the diameters of all of the beads thereon, such that when said first and second cords are in a relaxed state, each of said beads, on their respective cords, is in physical contact with the beads which are adjacent thereto;

(b) placing a portion of the first cord between the first pair of beads transverse to a portion of the second cord between the second pair of beads when each of the first pair of beads is in physical contact with the other of the first pair of beads and each of the second pair of beads is in physical contact with the other of the second pair of beads;

(c) stretching at least one of the first cord and the second cord to open at least one gap between at least one of the first pair of beads and the second pair of beads;

(d) placing the portion of the first cord between the first pair of beads in physical contact with the portion of the second cord between the second pair of beads;

(e) wrapping the portion of the first cord between the first pair of beads at least partially around the portion of the second cord between the second pair of beads; and (f) closing the at least one gap between the at least one of the first pair of beads and the second pair of beads while the portion of the first cord between the first pair of beads is in physical contact with and at least partially wrapped around the portion of the second cord between the second pair of beads and so that each of the first pair of beads is in physical contact with the other of the first pair of beads and each of the second pair of beads is in physical contact with the other of the second pair of beads.

23. The method of claim 22, wherein the step of providing the at least first and second separate beaded string elements includes a step of providing the at least first and second separate beaded string elements such that each of the beads included in the first and second pairs of beads is spherical in shape.

24. The method of claim 22, wherein the step of closing the at least one gap includes a step of closing the at least one gap such that each of the beads included in the first and second pairs of beads contacts the other three beads included in the first and second pairs of beads.

25. The method of claim 22, wherein the step of providing the at least first and second separate beaded string elements includes a step of providing a third separate beaded string element including a third pair of beads disposed on a third cord that is separate from each of the first and second separate cords, and wherein the method further includes steps of:

placing a portion of the third cord between the third pair of beads transverse to each of the portion of the first cord between the first pair of beads and the portion of the second cord between the second pair of beads;

stretching at least one of the first, second, and third cords to open at least one gap between at least one of the first, second and third pairs of beads;

placing the portion of the third cord between the third pair of beads in physical contact with each of the portion of the first cord between the first pair of beads and the portion of the second cord between the second pair of beads;

wrapping the portion of the third cord between the third pair of beads at least partially around each of the portion of the first cord between the first pair of beads and the portion of the second cord between the second pair of beads; and closing the at least one gap between the at least one of the first, second, and third pairs of beads while the third portion of the third cord is in physical contact with and at least partially wrapped around each of the portion of the first cord between the first pair of beads and the portion of the second cord between the second pair of beads.

26. The method of claim 25, wherein the step of closing the at least one gap between the at least one of the first, second, and third pairs of beads includes a step of closing the at least one gap between the at least one of the first, second, and third pairs of beads such that each of the beads included in the first, second, and third pairs of beads contacts four other beads included in the first, second, and third pairs of beads.

27. The method of claim 22, wherein the step of providing the at least first and second separate beaded string elements includes a step of providing the at least first and second separate beaded string elements such that each of the beads included in the first and second pairs of beads is made of a material selected from a group consisting of plastic, metal and wood.

28. The method of claim 22, wherein the step of providing the at least first and second separate beaded string elements includes a step of providing the first beaded string element such that each of the first pair of beads is of a same size and shape as the other of the first pair of beads.

29. The method of claim 22, wherein the step of providing the at least first and second separate beaded string elements includes a step of providing the at least first and second separate beaded string elements such that all of the beads included in the first and second pairs of beads are of a same size and shape.

30. The method of claim 23, wherein the step of providing the at least first and second separate beaded string elements includes a step of providing the at least first and second separate beaded string elements such that all of the beads included in the first and second pairs of beads are of a same size and shape.

31. The method of claim 22, wherein the step of providing the at least first and second separate beaded string elements includes a step of providing the at least first and second separate beaded string elements such that no manipulable objects other than beads are disposed on either of the first and second separate cords.

32. The method of claim 22, further comprising a step of:

(g) repeating the steps (a), (b), (c), (d), (e), and (f) at least once using another set of first and second pairs of beads disposed, respectively, on the first and second separate cords to create at least one geometric figure with the plurality of beaded string elements.

* * * * *

UNITED STATES PATENT AND TRADEMARK OFFICE

CERTIFICATE OF CORRECTION

PATENT NO. : 6,241,572 B1
DATED : June 5, 2001
INVENTOR(S) : Braginsky

It is certified that error appears in the above-identified patent and that said Letters Patent is hereby corrected as shown below:

Column 6, claim 1,
Line 25, after "state" and before the comma, please insert -- or slightly tensioned --.

Column 7, claim 10,
Line 40, change "tan" to -- than --.
Line 43, after "state" and before the comma, please insert -- or slightly tensioned --.

Column 9, claim 22,
Line 46, after "state" and before the comma, please insert -- or slightly tensioned --.

Signed and Sealed this

Nineteenth Day of February, 2002

*Attest:*

*Attesting Officer*

JAMES E. ROGAN
*Director of the United States Patent and Trademark Office*